US006296055B1

(12) United States Patent
Taylor

(10) Patent No.: US 6,296,055 B1
(45) Date of Patent: Oct. 2, 2001

(54) COMBINATION RETRIEVABLE DRILLING FLUID FILTER AND WIPER

(76) Inventor: Kyle Lamar Taylor, 17718 Surreywest La., Spring, TX (US) 77379

( * ) Notice: Subject to any disclaimer, the term of this patent is extended or adjusted under 35 U.S.C. 154(b) by 0 days.

(21) Appl. No.: 09/478,394

(22) Filed: Jan. 6, 2000

(51) Int. Cl.[7] ..... E21B 12/06; E21B 37/08

(52) U.S. Cl. ..... 166/205; 166/229; 210/497.3

(58) Field of Search ..... 166/205, 227, 166/228, 229, 296; 210/497.01, 497.3

(56) References Cited

U.S. PATENT DOCUMENTS 2,152,980 * 4/1939 Svadlenak .
2,942,670 * 6/1960 Burns et al. .
3,450,207 * 6/1969 Hirsch .
4,495,073 1/1985 Beimgaben .
5,762,137 6/1998 Ross et al. .

* cited by examiner

*Primary Examiner*—Roger Schoeppel
(74) *Attorney, Agent, or Firm*—Michael B. Jolly

(57) ABSTRACT

A combination collar based retrievable drilling fluid filter and wiper with threaded ends for easy inclusion within the drill string, and a through bore for passage of drilling fluids and insertion of a wire line retrievable filter and wiper unit which is concentrically received and supported by the collar. The filter and wiper unit include a filter insert and an elongated wiper carrier. The filter insert is positioned at an upper end of the apparatus and is received by the elongated wiper carrier which is positioned at the lower end of the apparatus. The elongated wiper carrier includes numerous wiper brushes which help remove scale from the interior of the drill string when the filter and wiper unit is retrieved. Electrical wiring passes easily through the apparatus for operation of down hole instruments if desired.

9 Claims, 9 Drawing Sheets

SECTION A–A

SECTION B–B

SECTION C–C

SECTION A–A

SECTION B–B

SECTION C–C

COMBINATION RETRIEVABLE DRILLING FLUID FILTER AND WIPER

TECHNICAL FIELD

The present invention relates to down hole drilling fluid filtration devices and more particularly to a combination down hole drilling fluid retrievable filtration device which facilitates erosion of particles in the drilling fluid stream to a size that allows harmless passage through delicate down hole tools and a wiper that cleans the interior of the drill string when the filtration device is retrieved. The filtration device may be placed at any desired location on the drill string and the internal component is retrievable by wire line if an occlusion occurs without the need for tripping out the string. The wiper assist in removing scale each time the tool is retrieved.

BACKGROUND ART

Circulation of drilling fluids during the drilling of subterranean wells is necessary for the operation of numerous down hole tools, such as turbines and delicate measurement instruments. It is desirable that the drilling fluid does not contain particles of a size that will damage the tool and necessitate pulling the drill string and repairing or replacing the tool. In an attempt to avoid this problem drilling fluids are filtered to remove the damaging particles before being re-circulated down hole. These methods and devices work well for removing particles before the fluid enters the drill string, however it is well known that damaging scale particles often originate from locations within the drill string where scale or cement builds up and eventually is knocked loss and carried along with the drilling fluid stream into contact with valuable and delicate down hole tools. Scale on the interior surface of the drill string originate from numerous sources such as rust, ferrous carbonate, and iron sulfide deposits. While cement is deposited on the interior of the drill string during cementing operations. Scale and cement deposits are known to be freed from the tubular walls by the forces created by drilling operations, moving the drill string, or the flow of drilling fluid. The loose cement or scale particles are a constant source of blockage and/or damage of down hole tools. When the tool is damaged or plugged by these particles the entire drill string must be tripped out of the hole in order to remove the occlusion or repair the tool resulting in valuable rig down time. Presently, the recommended practice to prevent these problems include time consuming procedures such as the following:

1. Rabbit all pipe and subsequent pipe joints.
2. High pressure cleaning of the pipe interior using a pig.
3. Knock loose debris off the interior walls of drilling pipe with a hammer.
4. Wash the interior of the pipe with available rig water.
5. Circulate drilling fluid for an additional period of time at full stroke during fill-ups at trips to prevent the particles from settling and blocking tools.
6. Run a caustic sweep prior to retrieving tools.

A filtering option is disclosed by Beimgraben U.S. Pat. No. 4,495,073 which describes a filtering device or screen incorporated within any location of a drill string and which is retrievable by fishing tools. This device is useful for filtering fluids in close proximity to down hole tools, however when the clogged filter screen is withdrawn from deep in the drill string, scale is frequently dislodged from the interior surface and collar joints of the drill string and allowed to fall down hole behind the filter and ultimately into contact with down hole tools. Additionally, the filter screen has relatively low capacity and is frequently clogged resulting in undesirable down time.

The present invention provides an alternative to the present practices employed to remove scale and/or cement described above and overcomes problems with filtering drilling fluid by providing a filtering device that removes damaging particles from the fluid by facilitating the erosion of damaging particles in the drilling fluid stream to a size that can easily pass through down hole tools without damage. The present device is retrievable by wire line, may be placed at any location in the drill string, includes wipers that assist with the removal of scale or cement from the interior surface of the drill string when the filter is retrieved, may be placed in close proximity to down hole tools, is rarely clogged by scale or cement particles, is easily cleaned, may be used with electronic wire routed through the device, and is easily reinserted into place with minimal down time.

The present invention also provides a means for breaking up plugs of lost circulation material (LCM). LCM consist primarily of wood particles, nutshells, paper, cellophane, sugar cane pulp, cotton seed hulls, acid soluble cement or minerals and are graded as either fine, medium or course particle size. LCM is known to form plugs or clumps which, when pumped down hole plug tools and down hole screens. Pulser screens with slots are used to break up medium or course LCM while a pulser screen with round openings is used to break up fine graded LCM. Prior to the present invention running both fine-medium or fine-course LCM would virtually assure a tool failure. The present invention breaks up clumps of LCM composed of any grade with out the need for pipe screens thus allowing for the addition of any grades of LCM to the drilling fluid.

GENERAL SUMMARY DISCUSSION OF INVENTION

The invention is a stand alone sub of approximately six feet in length with a box and pin configuration and may be manufactured of any collar size to accommodate all hole sizes. The filter collar has threaded ends for easy inclusion within the drill string, and has a through bore for passage of drilling fluids and insertion of a filter and wiper unit which is concentrically received and supported by the collar. The filter and wiper unit is made of two main sections; a filter insert and an elongated wiper carrier. The filter insert is positioned at an upper end of the apparatus and is coaxially, slidingly and longitudinally received by a filter insert receiving rod extending from the elongated wiper carrier which positioned at the lower end of the apparatus. The elongated wiper carrier is about the length of the filter collar and includes; the filter insert receiving rod which extends upwardly for coaxially receiving the filter insert, a middle wiper section where numerous wire brushes are mounted, and a centering post at the lower end for centering and aligning the filter and wiper unit within the filter collar bore. The filter insert has a wire line connection at the top end for retrieving the filter and wiper unit together, an elongated erosion section which includes an upper end for blocking larger diameter particles and a lower end for blocking smaller diameter particles, a wiper brush receiving cylinder mounted on the lower end of the filter insert, and a filter insert central bore extending the length of the filter insert and for receiving the filter insert receiving rod. The filter insert receiving rod and filter insert receiving bore are keyed for alignment and the filter insert is captured for limited longitudinal extension along the receiving rod from; an operational position where the wire brushes are contained within the receiving cylinder and the wiper insert centering post is fully received within the collar bore and the filter insert receiving rod is releasably engaged within the filter insert, to a retrieving position where the filter insert is pulled to its maximum longitudinal extension within the key way and the wiper brushes are removed from the receiving cylinder.

The filter collar interior includes an upper elongated erosion section with numerous interruptions that extend radially to a center longitudinal axis of the collar bore but allow a sufficient central bore size for insertion of the filter and wiper insert. The length of filter collar upper elongated erosion section coincides with the elongated erosion section of the filter insert to form numerous drilling fluid passageways. The size of the drilling fluid passageways are largest at the upper end and smallest at the lower end of the erosion section, thereby blocking the largest scale particles before entering the erosion section and while smaller particles are lodged within the erosion section and with erosion will eventually pass through the filter. The interior of the collar also includes a larger diameter wiper brush receiving cylinder area where the wiper brush receiving cylinder is positioned during operation of the tool, this area is large enough to allow drilling fluid to easily flow around the outside of the receiving cylinder. The filter collar centering bore is positioned near the lower end of the filter collar and is centrally aligned and keyed for centering and aligning the filter and wiper unit within the collar, numerous drilling fluid passageways are provided around the bore.

Electrical wiring may be routed through the filter for operation of electronic instruments below the filter if desired.

Retrieving the filter and wiper insert is accomplished by attachment of a fishing tool to the top end of the filter insert, the filter insert is then pulled longitudinally upward thereby disengaging the filter insert and filter insert receiving rod from the operational position and longitudinally sliding the filter insert along the filter insert receiving rod to a maximum upward extension and retrieving position while at the same time the wiper brush receiving cylinder is removed upwardly over the wiper brushes thereby liberating the wiper brushes, at this point the wiper carrier has not moved, continued upward retrieval then begins to longitudinally move the wiper carrier which disengages the centering post from the filter collar centering bore and extract the complete filter and wiper insert from the filter collar and through the remainder of the drill string to the surface thereby wiping the interior of the drill string to the surface. Once on the surface, the filter and wiper is readied for reinsertion into the collar by first reinserting the wiper brushes into the wiper brush receiving cylinder while also sliding the filter insert receiving rod into the filter insert and pushing the filter insert to the limits of travel within the captured key way to its engaged operational position. The filter and wiper insert is then lowered into the filter collar where the insert is aligned, centered and releasably engaged by the filter collar centering bore receiving the centering post.

It is thus an object of the present invention to provide a combination retrievable drilling fluid filter and wiper that is positionable in any location of a drill string and which erodes scale particles to a size that can easily pass through down hole tools without damage. The present invention also provides a drilling fluid filter and wiper that is positionable in close proximately with down hole tools thereby assuring that damaging scale particles that may be dislodged from an interior surface of the drill string are eroded to a small diameter. Another object of the invention to provide a combination retrievable drilling fluid filter and wiper that is easily retrievable by wire line with minimal down time. Another object of the invention to provide a combination retrievable drilling fluid filter and wiper that when retrieved provides a wiper which helps remove scale buildup in the interior of the drill string and thus preventing dislodged scale from falling behind the retrieved filter and damaging the down hole tool.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1A:
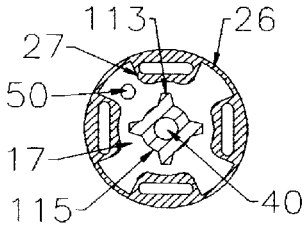
FIG. 1A is a cross section of the filter taken along lines A—A of FIG. 1 illustrating the upper end of the filter insert and upper end of the filter collar upper erosion section.

It can be seen from the following description that the combination retrievable drilling fluid filter and wiper is extremely useful for inclusion within any desired location on a drill string for a subterranean drilling operation and providing a filter for drilling fluids such as drilling mud in close proximity to delicate down hole tool. It is well known that scale or cement build up in the interior of a drill string often dislodge and fall down hole in the stream of circulating drilling mud and damage delicate turbines, measuring equipment and the like. Filtering the mud at the surface does not solve this problem, likewise filtering the particles with a collar based filter basket arrangement has capacity limitations and further when the filter basket is retrieved, the motion of retrieving the basket to the surface through the drill string often dislodges scale build up which then falls behind the retrieving basket to damage the down hole tool. It is also well known in the industry that circulating drilling mud is highly erosive, and that scale and concrete, is erodeable if placed in the drilling mud stream. It is also known that small diameter scale particles, about one quarter inch in diameter, may freely flow through a down hole tool without damage. The present invention utilizes the erosive capacity of the circulating drilling fluid to erode scale particles to a size which allows easy passage through delicate down hole tools without damage. The present invention also provides a means for breaking up clumped LCM with out the need for pulser screens.

The filter and wiper include a filter collar 20 which is dimensioned to comply with the drill string collar size of the specific drilling operation of interest. Accordingly, this invention may be easily adapted to include numerous sizes each of which is specific for a particular drill collar size, all other components of the filter and wiper will be dimensioned to match the appropriate drill collar size. The filter collar 20 includes a female threaded top end 21 for mating with a male threaded end of the drill string collar 15 and a male threaded lower end 22 for mating with a female threaded end of the drill string collar, a through bore 23 for passage of drilling fluid and insertion of a filter and wiper unit 40. An annular drilling fluid passage way 17 is formed by the space between the interior surface of the through bore 23 and centrally positioned filter and wiper insert 40.

Figure 1B:
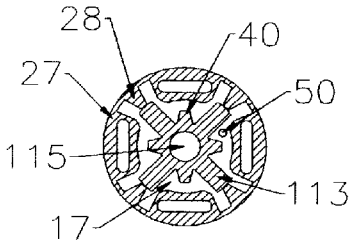
FIG. 1B is a cross section of the filter taken along lines B—B of FIG. 1 about midway between the top and bottom ends of the filter insert filter collar upper erosion section illustrating the smaller diameter drilling fluid passage ways than as depicted in FIG. 1A.
Figure 1C:
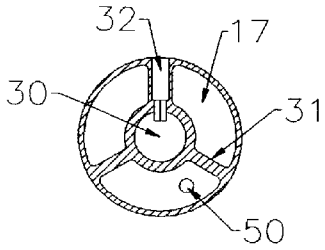
FIG. 1C is a cross section of the filter taken along lines C—C of FIG. 1 illustrating the filter collar centering bore for receiving the centering post, key way, and numerous drilling fluid passage ways around the centering bore.
Figure 1:
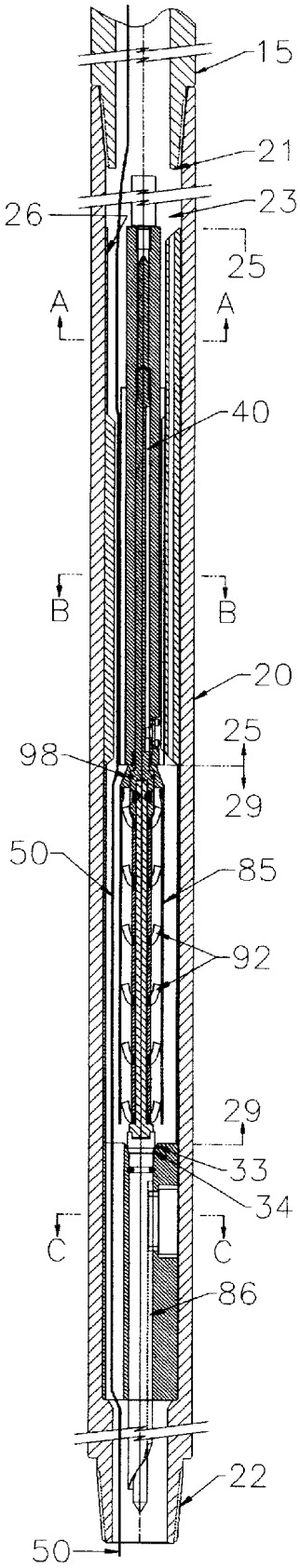
FIG. 1 is a longitudinal cross section of the combination drilling fluid filter and wiper, illustrating the filter collar with the filter and wiper unit inserted in the operational position, wherein the filter insert is at its lowest longitudinal position, the wiper brushes are contained within the wiper brush receiving cylinder, the filter insert is releasable engaged with the filter insert receiving rod, and the wiper carrier centering post is releasable engaged with the filter collar centering bore.
Figure 5A:
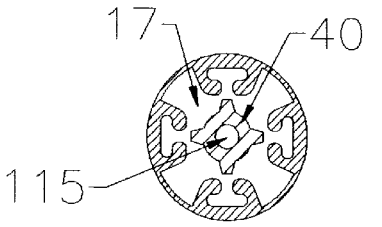
FIG. 5A is a cross section taken along lines A—A of FIG. 5 illustrating a variation of the filter and collar erosion section interruptions.
Figure 5B:
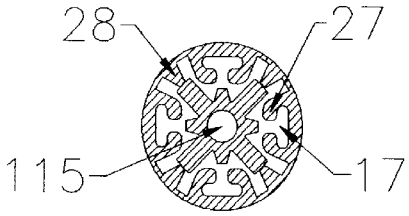
FIG. 5B is a cross section taken along lines B—B of FIG. 5 illustrating a variation of the filter and collar erosion section interruptions.

The through bore 23 of the filter collar 20 has components which must align with specific components of the filter and wiper unit 40, the elongated wiper carrier 90 and the filter insert 110. Starting at the upper end of the filter collar 20 the first component is the filter collar erosion section 25 which extends between the two arrows of FIG. 1 labeled 25. The filter collar erosion section 25 is about one foot to about three feet in length and includes numerous interruptions 27 which extend from an interior surface 26 of the through bore 23 into the annular drilling fluid passage way 17. FIG. 1A is a cross section of the filter collar 20 taken along lines A—A of FIG. 1 illustrating the relation of the filter and wiper insert 40, the filter collar 20, the interruptions 27 and the annular passage way 17. The interruptions 27 function to fragment the annular passage way 17 into smaller passages thereby excluding the passage of large scale or cement particles through the annular passage way 17. The larger scale or cement particles are blocked or wedged in the annular passage way 17 where they are exposed to drilling fluid erosion and size reduction. FIG. 1B illustrates a cross section of the filter collar 20 taken along lines B—B of FIG. 1 which shows additional interruptions 28 to further reduce the size of the annular passage way 17 and block the passage of even smaller scale or cement particles. The pattern of the interruptions 27 may vary, an alternative pattern is illustrated in FIGS. 5A and 5B, the object of the interruptions is to gradually decrease the annular drilling fluid passage way 17 from a maximum size near the upper end of the upper elongated erosion section 25 to a minimum size near the lower end of the upper elongated erosion section 25, this assures that larger particles will be blocked from passage in a different location than small diameter particles that may pass half way through the erosion section thus providing more capacity for the filter.

Below the filter collar elongated erosion section 25 is a wiper brush receiving area 29 where the interior diameter of the collar bore 23 is increased to accommodate the wiper brush receiving cylinder 85 along with a continuation of the annular drilling fluid passage way 17 when the wiper brush receiving cylinder 85 is in place, without minimizing the size of the annular drilling fluid passage way 17. The length of the wiper brush receiving area 29 is illustrated in FIG. 1 between the arrows labeled 29.

Figure 5C:
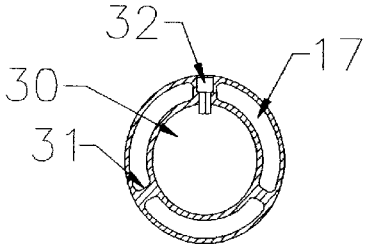
FIG. 5C is a cross section taken along lines C—C of FIG. 5 illustrating an increased diameter filter collar centering bore for accommodating passage of down hole tools if desired.

Below the wiper brush receiving area 29 is the filter collar centering bore 30 which is centrally located within the collar bore 23. The centering bore 30 serves as a receiving bore for the centering post 86 of the elongated wiper carrier 90, to align and center the filter and wiper unit 40. The centering bore 30 is supported by at least three spokes 31 extending from the interior surface 26 of the filter collar while the annular drilling fluid passage way 17 is positioned around each spoke 31 and the centering bore 30. The centering bore 30 is keyed 32 for aligning the grooved centering post 86 and beveled 33 at the upper entrance 34 to provide easy stabbing of the centering post 86 into the centering bore 30. The diameter of the centering bore 30 may be enlarged as illustrated in FIG. 5C to allow the passage of down hole tools through the filter collar 20. The interior diameter of the centering bore 30 and other locations in the interior of the filter collar must be at least one and seven eights inch in diameter to allow passage of down hole tool through the filter collar 20.

Figure 9:
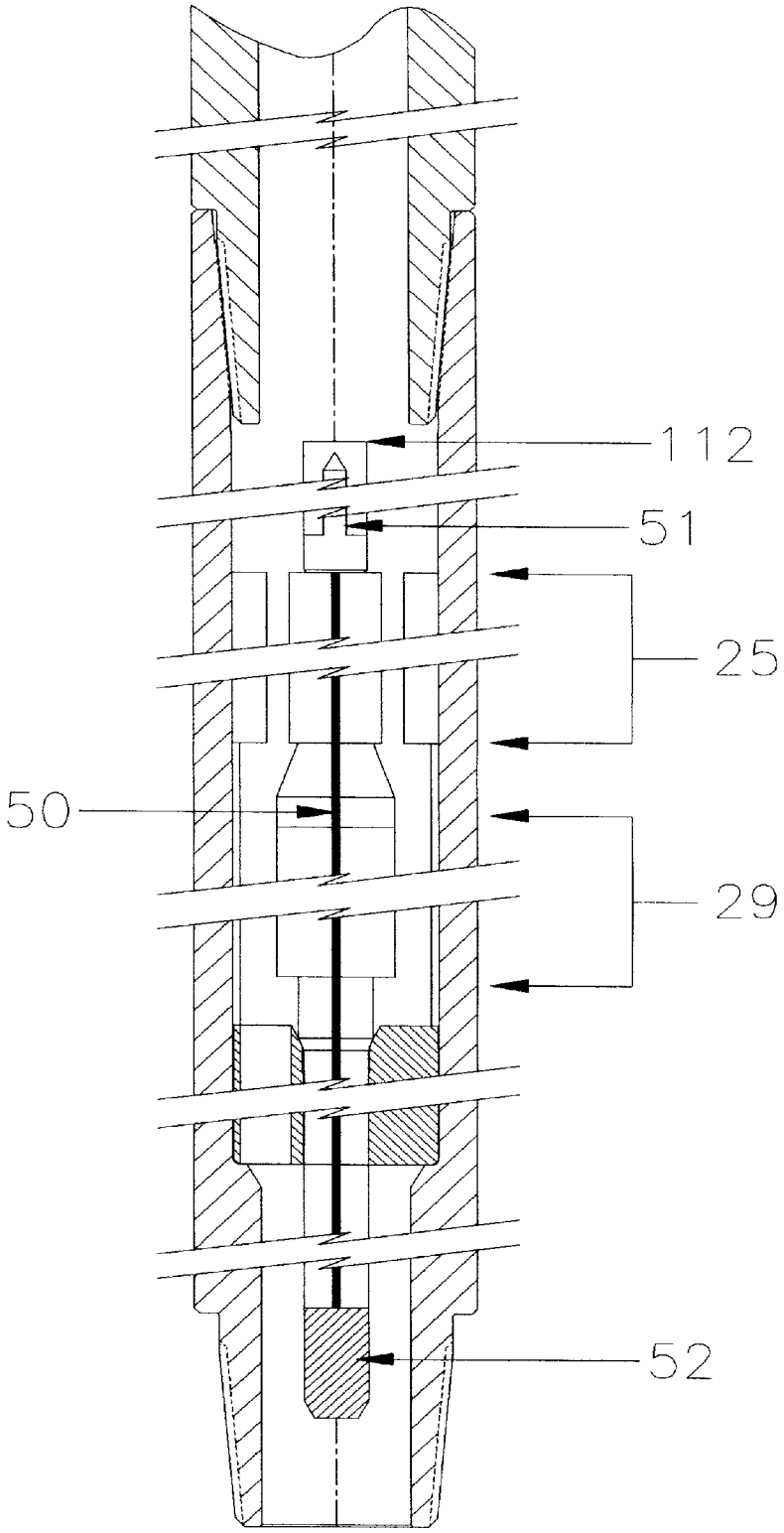
FIG. 9 is a reduced length cross section of the apparatus illustrating an addition of a through wire.

Electrical down hole instrument wiring 50 may easily be routed through the entire filter and wiper unit and filter collar if it is desire to operate instrumentation down hole of the apparatus. FIG. 9 illustrates the centrally position wire 50 extending the entire length of the filter and wiper unit 40. A wet stab connection 51 and 52 is provided at each end of the filter and wiper unit 40 to allow for a contact link to measurement equipment below the apparatus so information may be downloaded. An electrical connection is also provide between the filter insert and the elongated wiper carrier. The lower wet stab connection 52 would remain in connection with down hole equipment during drilling operations while the upper wet stab connection 51 would only be made when the wire line connection 112 is lowered to connect to the filter and wiper unit 40.

Figure 2:
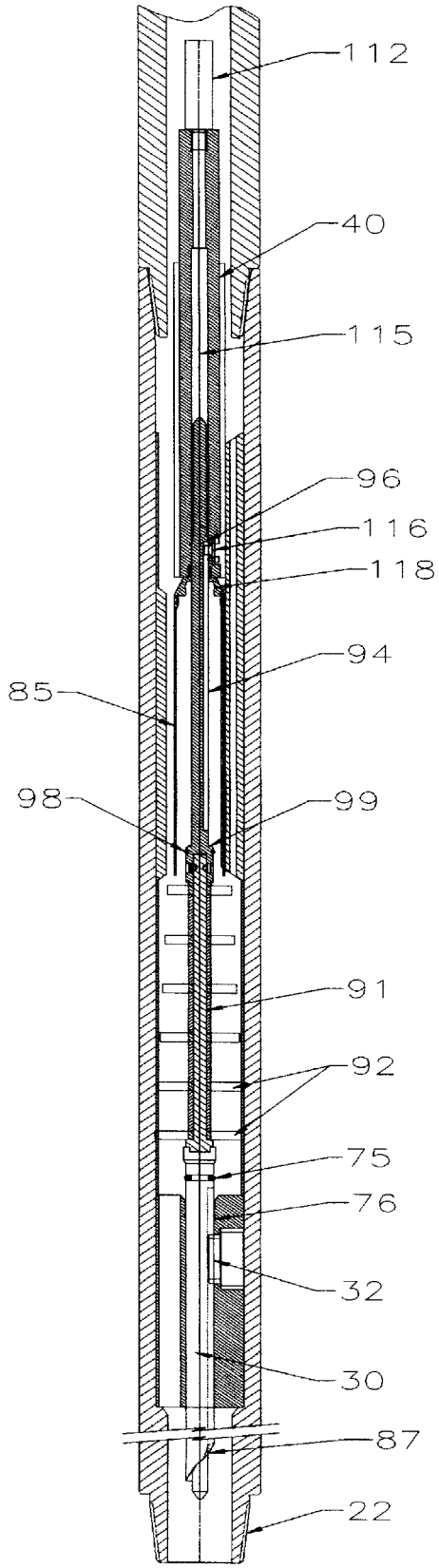
FIG. 2 is a longitudinal cross section of the filter with a wire line connected to a top end of the filter insert and with the filter insert pulled to its maximum upper length of travel with the wiper brushes liberated from the wiper brush receiving cylinder and the elongated wiper carrier centering post ready to be disengaged from the filter collar centering bore.
Figure 3:
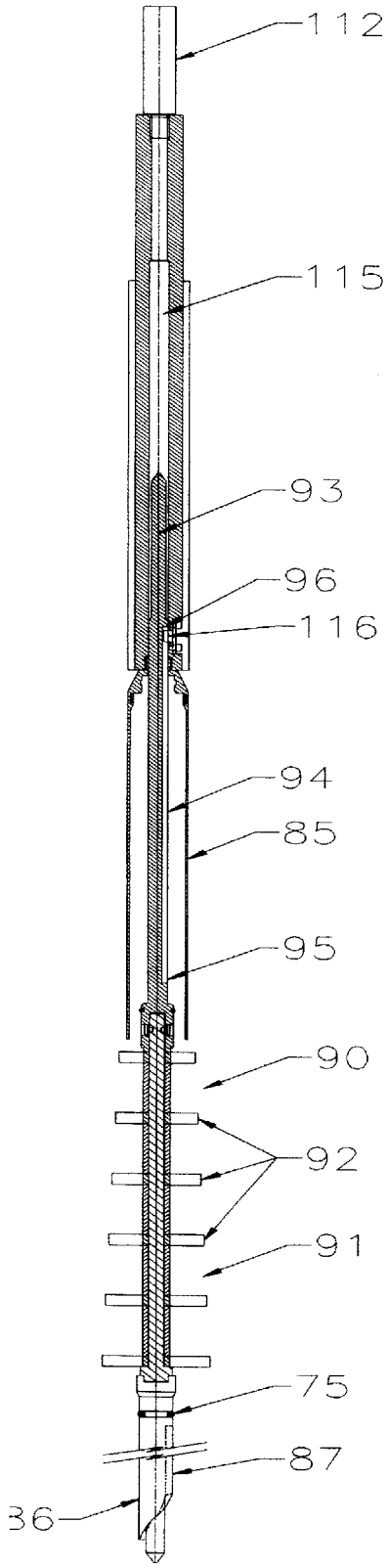
FIG. 3 is a cross section longitudinal view of the filter insert and elongated wiper carrier removed from the collar with the filter insert moved to its maximum upper extent of travel with the wiper brushes exposed for wiping an interior of a drill string.
Figure 4:
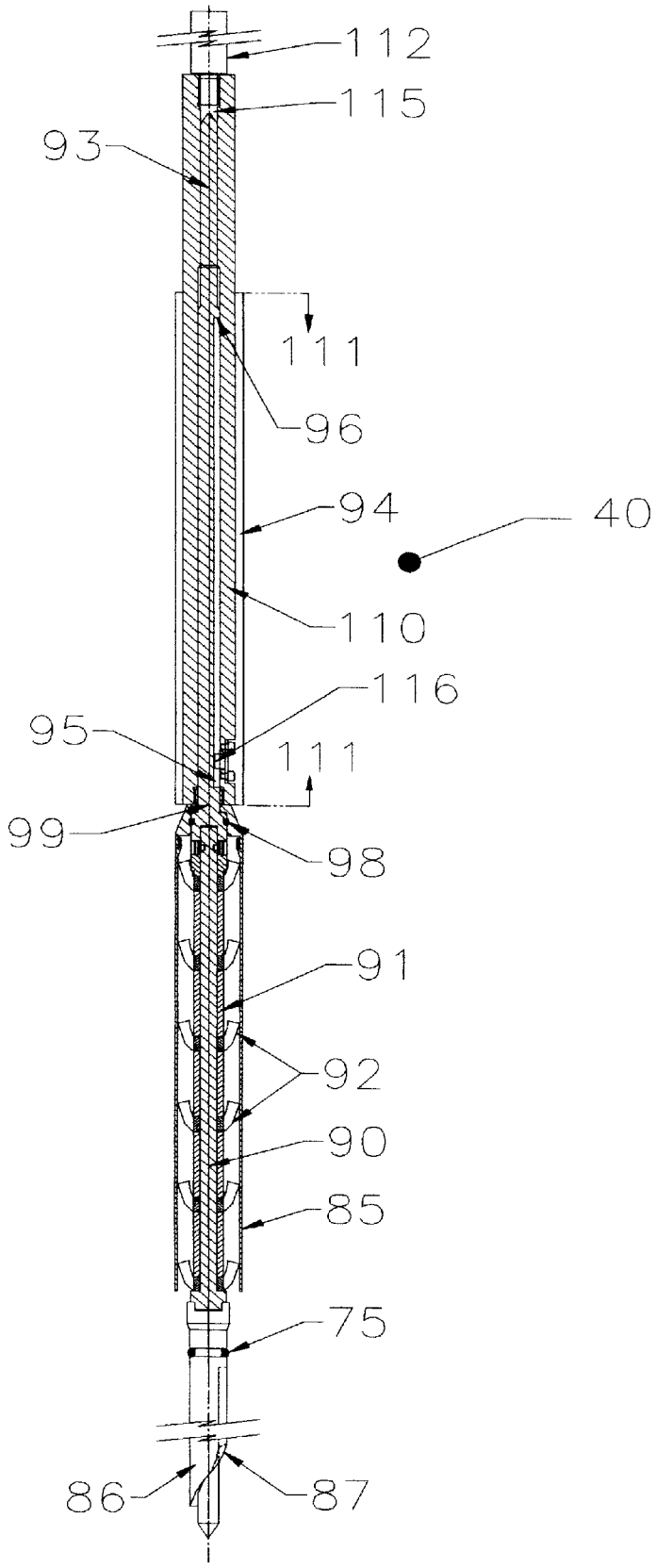
FIG. 4 is a cross section longitudinal view of the filter insert and elongated wiper carrier moved to its operational position and readied to be reinsert into the filter collar with the filter insert receiving rod releasably engaged within the filter insert central bore with the wire brushes contained within the cylindrical sleeve.
Figure 5:
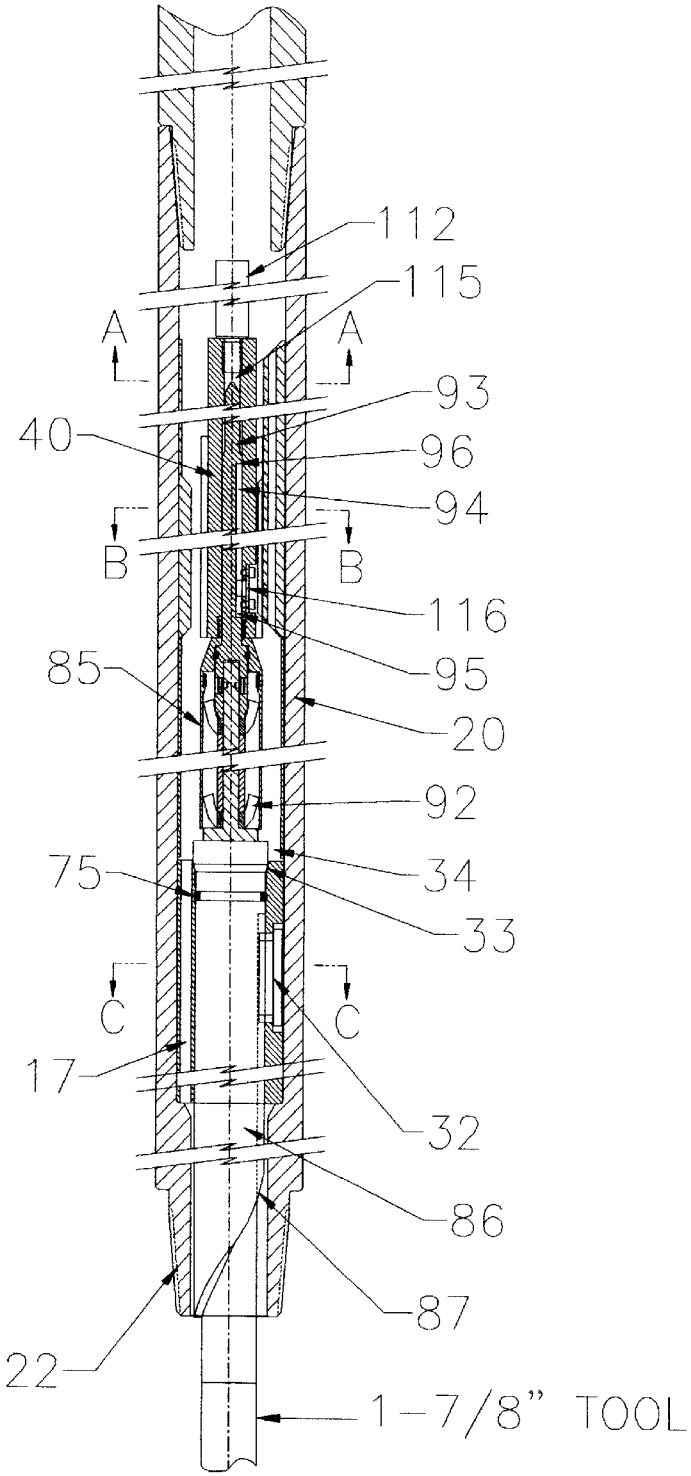
FIG. 5 is a reduced length close up longitudinal cross sectional view of the filter and wiper unit installed in the filter collar illustrating the components of the device and an alternative configuration of the erosion section of the filter insert and the filter collar upper erosion section further with an increased diameter filter collar centering bore for accommodating tools below the filter if desired.
Figure 6:
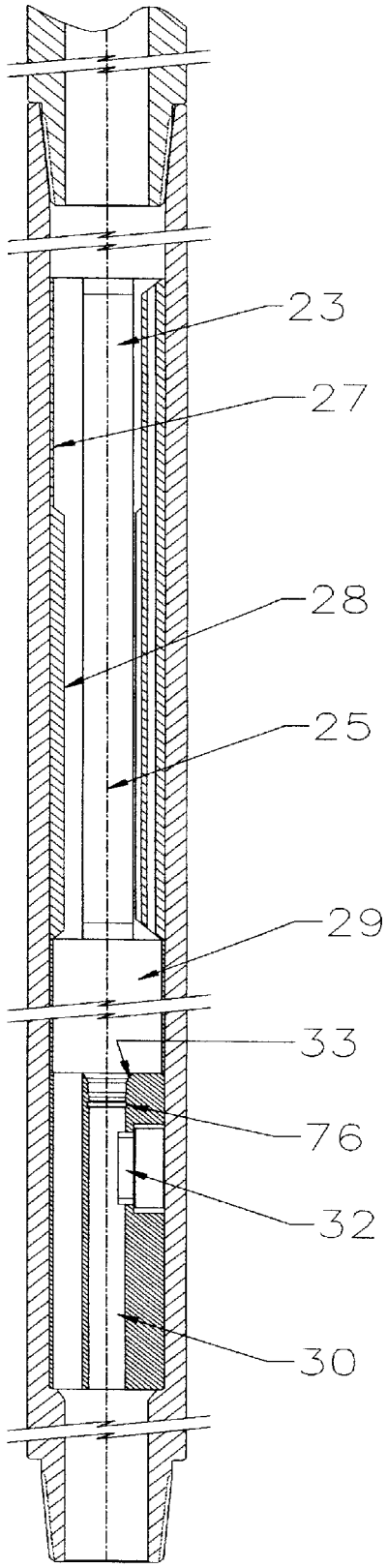
FIG. 6 is a cross section of the filter collar with the filter and wiper unit removed.
Figure 7:
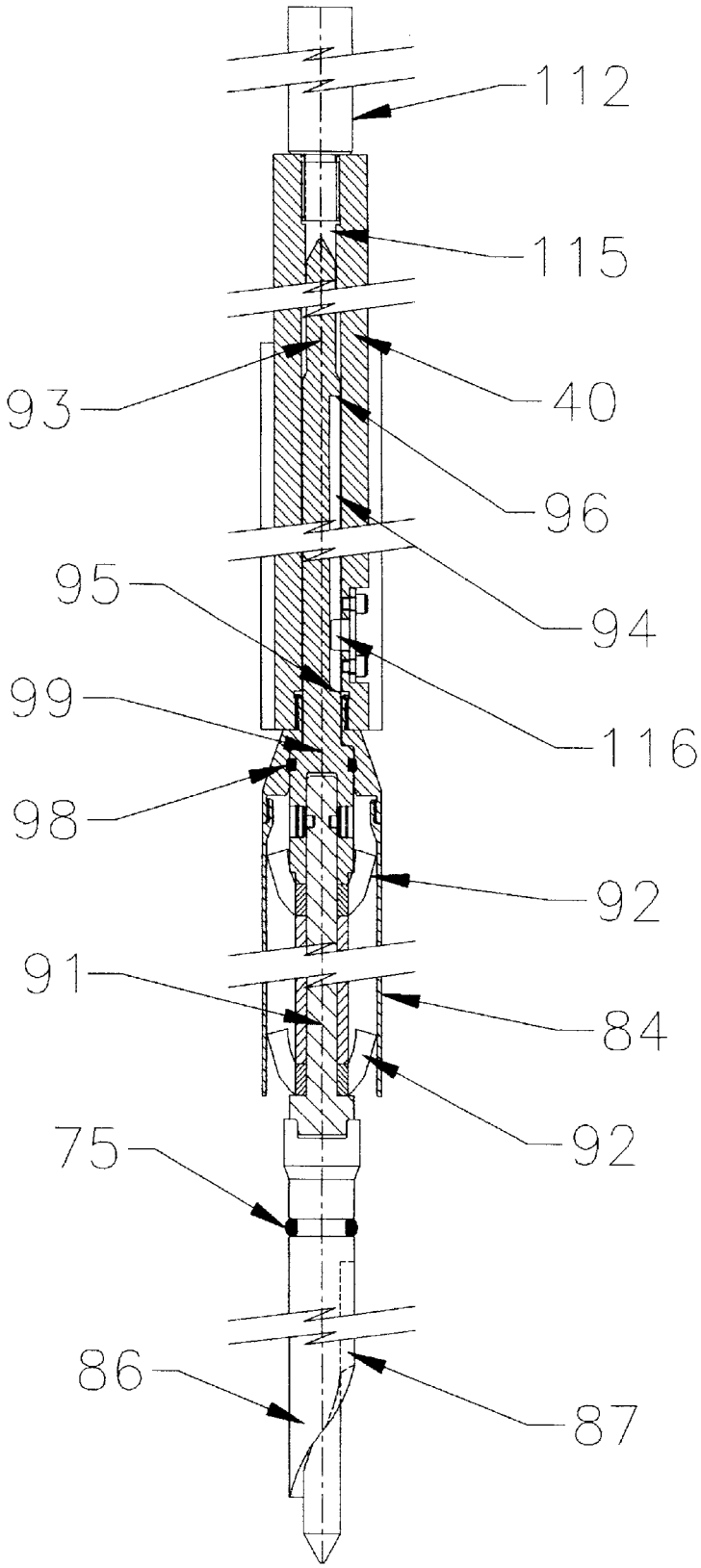
FIG. 7 is a reduced length cross section of the filter and wiper unit with the wiper brushes contained within the wiper brush receiving cylinder.
Figure 8:
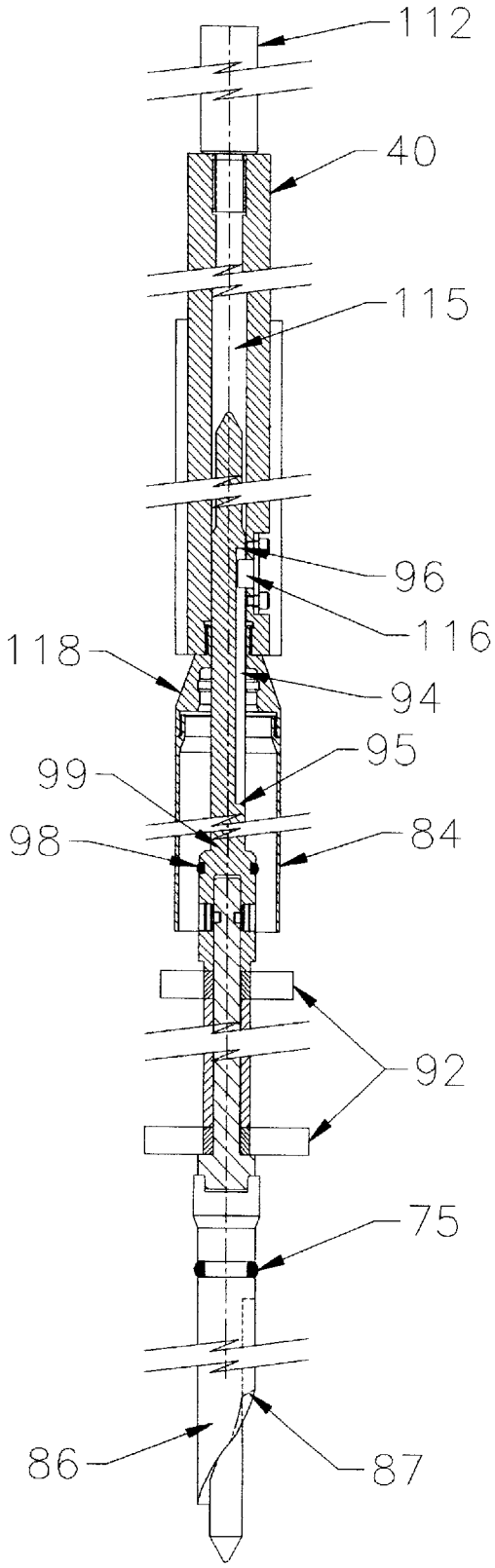
FIG. 8 is a reduced length cross section of the filter and wiper unit in a retrieval position with the wiper brushes liberated from the wiper brush receiving cylinder.

The filter and wiper unit 40 is composed of two main parts; the filter insert 110 and the elongated wiper carrier 90. The filter insert 110 includes a filter insert elongated erosion section 111 which extends between the arrows labeled 111 on FIG. 4. The filter insert elongated erosion 111 includes numerous splines 113 which extend into the annular passage way 17 and between the interruptions 27 to further fragment the annular passage way. Similar to the filter collar erosion section 25, the filter insert erosion section includes additional splines near the lower end of the elongated erosion section to assure that the smallest scale or cement particles are trapped and held in the drilling fluid stream to erode before traveling down hole. The cross sections 1A, 1B, 5A, and 5B illustrate the relation of the splines 113 and the interruptions 27 and 28. The design, shape or number of the splines may be varied without departing with the intent of the invention, FIGS. 5A–B and 1A–B illustrate variations of the splines which may be considered. At the top end of the filter insert is a wire line connection 112 which allows the entire filter and wiper unit 40 to be retrieved from the filter collar 20. The filter insert 110 includes a central bore 115 positioned centrally and longitudinally through the filter insert 110 extending the length of the erosion section 113 for receiving an elongated receiving rod 93. A wiper brush receiving cylinder 85 is attached with threads 88, which could be either male or female threads to a lower end of the filter insert shouldered are 99 and serves as a storage area for the wiper brushes 92 when the apparatus is in operation position and when the filter and wiper unit 40 is reinstalled within the filter collar 20. The wiper brush receiving cylinder 85 is removable to allow for the reinsertion of the wiper brushes 92. The elongated wiper carrier 90 includes a filter insert receiving rod 93 positioned at a top end for slidingly receiving the filter insert 110, a middle wiper brush section 91 for mounting numerous wiper brushes 92 in line, and a lower centering post 86 which is received by the filter collar centering bore and which centers, aligns and mounts the filter and wiper unit 40. The filter insert central bore 115 includes a key 116 while the filter insert receiving rod 93 includes a key way 94, additionally the centering post 86 includes a ramped key way 87 while the filter collar centering bore 30 includes a key 32, the arrangement of the keys and key ways assure that the filter insert 110 is maintained in proper orientation with the elongated wiper carrier 90 and that the filter and wiper unit 40 is installed in proper orientation with the filter collar. Another function of the key 116 on the filter insert receiving bore 115 and the key way 94 is to limit the longitudinal sliding movement of the filter insert 110 in relation to the wiper insert 90. Since the key way 94 has closed ends 95 and 96, the filter insert key 116 is allowed to travel longitudinally within the key way 94 from the lower key way end 95 to the upper key way end 96. When the filter insert key 116 is at the lower end of the key way 95, the wiper brush receiving cylinder 85 is positioned over the wiper brushes 92, this is the operational position as shown in FIGS. 1 and 5, or reinstallation position as shown in FIGS. 4 and 7. When the filter insert 110 is pulled upward, such as when retrieving by wire line, the filter insert key 116 travels longitudinally within the key way 94 to the upper key way end 96, this is the retrieval position as shown in FIGS. 2,3, and 8. In the retrieval position the wiper brush receiving cylinder 85 has been pulled upward longitudinally with the filter insert 110 liberating the wiper brushes 92. The filter insert receiving rod 93 and the filter insert receiving bore 115 are releaseably engaged when in the operational position. The releaseable engagment is provided by an O-ring 98 positioned on a shouldered area 99 between the filter insert receiving rod 93 and middle wiper section 91 mates with an O-ring groove 118 positioned between the elongated erosion section 113 and the wiper brush receiving cylinder 85 of the filter insert 110. Likewise, the centering post 86 and filter collar centering bore are releasably engaged by an O-ring 75 positioned on an upper end of the centering post 86 and which mates with an O-ring groove 76 within the filter collar centering bore 30. For proper retrieval of the filter and wiper unit 40, when the wire line connection 112 is made and when upward pulling of the filter and wiper unit 40 begin, it is required that the releasably engaged filter insert receiving rod 93 and central bore 115 is released before the centering post and bore engaged O-ring 75. This ensures that the filter insert 110 is in the retrieval position with the wiper brushes liberated, as shown in FIG. 2, before the wiper insert 90 begins to move out of the filter collar 20. Continued upward pulling of the wire line, once the filter insert key 116 has reached the upper end 96 of the key way 94, disengages O-ring 75 from its groove 76 and the wiper carrier then begins to move out of the filter collar 20. The inventor has found that the use of small and large O-rings in the different O-ring positions will provide different O-ring disengagement forces.

The wiper brushes 92 are preferably metal brushes and round with a diameter that does not require undue force to pull through the drill collar. Any number of wiper brushes 92 may employed and different diameter brushes may be used. It is preferable that the brushes are evenly spaced on the middle wiper brush section 91 with space between each brush to allow for brush flex and bending. Although the figures illustrate the use of five brushes more or less may be used without severely effecting the operation of the wiper. A concern of the inventor was to assure that when the wiper brushes are pulled through a drill collar, if there is an interruption on the interior surface, such as at the pin/box connections, will the brushes retain particles that have accumulated on the surface side of the brushes and not allow the particles to fall past the brushes? A test was conducted with the present invention wiper brush arrangement (six wire brushes; four 3 inch diameter brushes stacked on top of two 3.5 diameter brushes) and pulled through transparent pin/box connection that had a 2.5" internal diameter on the pin and 3.4" internal diameter on the box. This created an extreme interruption in the connection which would simulate a worse case scenario, while concrete particles ranging from ¼ inch to about 1½ inch were placed on the surface side of the top wire brush. Three test pulls were run and the only concrete particles that fell to the second wiper brush were those which fragmented to a size smaller than ¼ inch. The amount of force required to pull the wire brushes through the pin/box connection was 150 lbs.

In operation, the filter collar is placed in any desired location of a subterranean drill string, preferably in close proximity to any down hole tool. The filter and wiper insert is readied by detaching the wiper brush receiving cylinder 85 from the treaded section 88 of the shoulder 99 and inserting the wiper brushes into the wiper brush receiving cylinder 85 and then sliding the filter insert receiving rod fully into the filter insert central bore to a point where O-ring 98 engages with groove 118 and simultaneously threading the wiper brush receiving cylinder 85 back onto the threaded shoulder, the filter and wiper unit, which includes the filter insert and wiper carrier in the operation position, is then inserted into the filter collar 20 by lowering the filter and wiper insert until the centering post is fully received by the filter collar centering bore and when O-ring 75 engages with groove 76. During drilling operations the circulating drilling fluid travels through annular passage way 17 while larger particles of scale are trapped near the upper end of the erosion section and smaller particles are trapped in the middle to lower sections of the erosion section. The trapped particles are slowly eroded by the flowing drilling fluid until they are reduced to a size that allows passage along with the flowing drilling fluid. If an occlusion occurs a wire line is lowered down hole and connected to the top the filter insert, the filter insert is then pulled, disengaging the O-ring and longitudinally sliding the filter insert until the key travels up the key way to its maximum upward position thereby liberating the wiper brushes to a retrieval position, while continued upward pulling disengages the centering post O-ring and allows the filter and wiper unit to be retrieved to the surface while wiping the interior surface of the drill string. Once on the surface, the filter and wiper unit are readied for reinstallation.

It is noted that the embodiment of the retrievable filtration system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A drill collar based retrievable drilling fluid filter and drill string wiper tool for subterranean drilling operations, comprising;

a) a filter collar dimensioned for inclusion within a drill string with a central bore forming a drilling fluid passageway and a receiver for a filter and wiper unit, b) the filter and wiper unit include a filter insert slidably received by an elongated wiper carrier, the filter insert and filter collar includes a plurality of longitudinally positioned splines and interruptions which fragment the drilling fluid passageway into numerous drilling fluid passageways which block a flow of particles in the drilling fluid, the splines and interruptions vary in number and alignment from an upper end of the tool where the numerous drilling fluid passageways are largest to a lower end of the tool where the numerous drilling fluid passageways are smallest, c) the elongated wiper carrier includes numerous wiper brushes that are enclosed within a wiper brush receiving cylinder when the tool is in an operational position and removed from the wiper brush receiving cylinder before the wiper brushes are removed from the filter collar.

2. The drill collar based retrievable drilling fluid filter and drill string wiper tool for subterranean drilling operations as set forth in claim 1 further comprising;

a) a wire line connector attached to a top end of the filter and wiper unit for wire line retrieving the filter and wiper unit from down hole.

3. The drill collar based retrievable drilling fluid filter and drill string wiper tool for subterranean drilling operations as set forth in claim 1 further comprising;

a) a means for wire line retrieving the filter and wiper unit and removing the wiper brushes from the wiper brush receiving cylinder before the filter and wiper unit is withdrawn from the filter collar.

4. The drill collar based retrievable drilling fluid filter and drill string wiper tool for subterranean drilling operations as set forth in claim 1 further comprising;

a) electrical wiring extending centrally through the filter and wiper unit providing a means for sending and receiving electrical signals through the tool.

5. A drill collar based retrievable drilling fluid filter and drill string wiper tool for subterranean drilling operations, comprising;

a) a filter collar section and a wire line retrievable filter and wiper unit, the filter collar includes threaded ends dimensioned for inclusion of the filter collar within a drill string, a centering bore for concentrically receiving the filter and wiper unit, an annular drilling fluid passageway extending a length of the filter collar, a collar elongated erosion section with a plurality of interruptions positioned longitudinally on an interior surface of the filter collar and extending into the annular drilling fluid passageway, and a wiper brush receiving area positioned between the elongated erosion section and centering bore, b) the filter and wiper unit include a filter insert and an elongated wiper carrier, c) the elongated wiper carrier includes a lower centering post which is received by the filter collar centering bore for aligning and centering the filter and wiper unit, a wiper brush section above the centering post which includes a plurality of round wiper brushes evenly spaced and concentrically mounted thereto, and an upper elongated receiving rod for receiving the filter insert, d) the filter insert includes a wire line connector at a top end for retrieving the filter and wiper unit, a filter insert elongated erosion section positioned at an upper end of the filter insert and coinciding with a longitudinal length of the collar elongated erosion with a plurality of longitudinally positioned splines extending from the filter insert erosion section and extending into the annular drilling fluid passageway while a combination and alignment of the splines and interruptions extend into and fragment the annular drilling fluid passageway to form numerous smaller drilling fluid passageways where the number of interruptions and splines are dimensioned and aligned so that the number of fragmented annular drilling fluid passageways becomes progressively more numerous and smaller from an upper end of the erosion sections to a lower end of the erosion sections, a central bore extending centrally and longitudinally through the filter insert for slidingly receiving the upper elongated receiving rod from the wiper carrier while the receiving rod and central bore include a key captured within a key way for aligned and limited longitudinal movement of the filter insert on the elongated wiper carrier from an operational position to a retrieval position, a wiper brush receiving cylinder threadingly secured to a lower end of the filter insert erosion section for internally receiving the plurality of wiper brushes.

6. The drill collar based retrievable drilling fluid filter and drill string wiper tool for subterranean drilling operations as set forth in claim 5 further comprising;

a) electrical wiring extending centrally through the filter and wiper unit with an electrical connection located in the wire line connector on the filter insert, an electrical connection between the filter insert and elongated wiper carrier, and an electrical connection at a lower end of the wiper carrier thereby providing a means for receiving or sending electrical signals through the filter and wiper tool.

7. The drill collar based retrievable drilling fluid filter and drill string wiper tool for subterranean drilling operations as set forth in claim 5 wherein the lower centering post on elongated wiper carrier and the filter collar centering bore further comprise;

a) the filter collar centering bore includes a ramped key way and a beveled entrance while the centering post includes a key and a tapered end providing a means for inserting the elongated wiper carrier into the centering bore.

8. The drill collar based retrievable drilling fluid filter and drill string wiper tool for subterranean drilling operations as set forth in claim 5 wherein the operational and retrieval positions further comprise:

a) the operational position comprises: insertion of all wiper brushes within the wiper brush receiving cylinder, the upper elongated receiving rod is inserted fully within the filter insert central receiving bore, the centering post has been fully received by the filter collar centering bore, and the receiving rod and central bore key is at a limited extent of longitudinal travel within the key way, b) the retrieval position comprises: the receiving rod and central bore key is at an opposite limited extent of longitudinal travel as the operational position, all wiper brushes are removed from the wiper brush receiving cylinder, the elongated erosion section of the filter insert has been pulled longitudinally upwardly out of alignment with the erosion section of the collar and the centering post has been removed from the filter collar centering bore.

9. The drill collar based retrievable drilling fluid filter and drill string wiper tool for subterranean drilling operations as set forth in claim 5 wherein the operational and retrieval positions further comprise:

a) a means for releasably engaging the filter insert and the elongated wiper carrier in the operational position and a means for releasably engaging the filter and wiper unit in the filter collar so that releasable engagement of the filter insert and the elongated wiper carrier are released before the releasable engagement of the filter and wiper unit in the filter collar when the filter insert and elongated wiper carrier are moved from an operation position to a retrieval position and further providing a means for removing the wiper brushes from the wiper brush receiving cylinder before the filter and wiper unit is released from the filter collar.

* * * * *